US012569093B2

(12) United States Patent
Fellers, III

(10) Patent No.: US 12,569,093 B2
(45) Date of Patent: Mar. 10, 2026

(54) CONTROLLED DENTIFRICE DISPENSING DEVICE

(71) Applicant: Paul H. Fellers, III, Fairhope, AL (US)

(72) Inventor: Paul H. Fellers, III, Fairhope, AL (US)

( * ) Notice: Subject to any disclaimer, the term of this patent is extended or adjusted under 35 U.S.C. 154(b) by 145 days.

(21) Appl. No.: 18/401,967

(22) Filed: Jan. 2, 2024

(65) Prior Publication Data

US 2025/0064270 A1 Feb. 27, 2025

Related U.S. Application Data

(60) Provisional application No. 63/578,253, filed on Aug. 23, 2023.

(51) Int. Cl.

| | |
|---|---|
| ***A47K 5/00*** | (2006.01) |
| ***A45D 34/00*** | (2006.01) |
| ***A47K 5/12*** | (2006.01) |
| ***A47K 5/122*** | (2006.01) |

(52) U.S. Cl.

CPC ..... *A47K 5/00* (2013.01); *A45D 34/00* (2013.01); *A47K 5/1201* (2013.01); *A47K 5/122* (2013.01); *A45D 2200/055* (2013.01); *A45D 2200/056* (2013.01)

(58) Field of Classification Search

CPC ..... A47K 5/00; A47K 5/1201; A47K 5/122; A47K 5/1202; A47K 5/1204; A47K 5/1205; A45D 34/00; A45D 2200/055; A45D 2200/056

USPC ..... 222/401, 402.1, 402.17

See application file for complete search history.

(56) References Cited

U.S. PATENT DOCUMENTS

| | | | | |
|---|---|---|---|---|
| 3,949,906 | A * | 4/1976 | Pettersen | B05B 11/1059 222/321.9 |
| 5,363,992 | A * | 11/1994 | Meshberg | B05B 11/1059 222/153.13 |
| 2005/0121474 | A1* | 6/2005 | Lasserre | B65D 83/44 222/402.1 |
| 2022/0079319 | A1* | 3/2022 | Sabherwa | A45D 40/00 |

* cited by examiner

*Primary Examiner* — David J Walczak

(74) *Attorney, Agent, or Firm* — PATENTFILE, LLC; Bradley C. Fach; Steven R. Kick

(57) ABSTRACT

A controlled dentifrice dispensing device may include a reservoir configured to hold a volume of dentifrice. A pump may be configured to withdraw dentifrice from the reservoir when the pump is engaged by an actuator. The pump may be engaged by the actuator when the actuator is pressed towards the reservoir. The distance that the actuator is able to be pressed towards the reservoir may be controlled by one or more metering channels that may extend longitudinally towards the reservoir that may interact, directly or indirectly, with the actuator. When the actuator interacts with a relatively longer metering channel, the actuator may engage the pump to a greater degree than when the actuator interacts with a relatively shorter metering channel, thereby allowing the pump to withdraw a greater amount of dentifrice from the reservoir and to dispense the greater amount of dentifrice from the actuator, preferably onto a user's toothbrush.

19 Claims, 9 Drawing Sheets

CONTROLLED DENTIFRICE DISPENSING DEVICE

CROSS REFERENCE TO RELATED APPLICATIONS

This application claims priority to and the benefit of the filing date of U.S. Provisional Application No. 63/578,253, filed on Aug. 23, 2023, entitled "CONTROLLED DENTIFRICE DISPENSING DEVICE", which is hereby incorporated by reference in its entirety.

FIELD OF THE INVENTION

This patent specification relates to the field of devices for dispensing dentifrices. More specifically, this patent specification relates to a device for dispensing controlled amounts of dentifrices, such as toothpaste and gel.

BACKGROUND

The use of fluoride containing toothpaste has been shown to be important in maintaining healthy teeth and preventing cavities. However, it is critical to use the correct amount of fluoride containing toothpaste during each toothbrushing session to provide optimal effectiveness against cavities while minimizing the risk of negative effects from excessive fluoride ingestion from toothbrushing. This is particularly important for young children, so using a 'smear' or 'grain of rice' sized amount of fluoride toothpaste for children up to 3 years of age and a 'pea-sized amount' is recommended for ages 3-6 years. Unfortunately, as current literature has shown, many adults and children are unable to dispense and use the amount of fluoride toothpaste that is appropriate for the age of the tooth brusher.

Therefore, a need exists for novel devices for dispensing controlled amounts of dentifrices, such as toothpaste and gel.

BRIEF SUMMARY OF THE INVENTION

A controlled dentifrice dispensing device is provided. The device may include a reservoir that is configured to hold a volume of dentifrice. A pump may be coupled to the reservoir and configured to withdraw dentifrice from the reservoir when the pump is engaged by an actuator. The pump may be engaged by the actuator when the actuator is pressed towards the reservoir. The distance that the actuator is able to be pressed towards the reservoir may be controlled by a plurality of metering channels that may extend longitudinally towards the reservoir that may interact, directly or indirectly, with the actuator. When the actuator interacts with a relatively longer metering channel, the actuator may engage the pump to a greater degree than when the actuator interacts with a relatively shorter metering channel, thereby allowing the pump to withdraw a greater amount of dentifrice from the reservoir and to dispense the greater amount of dentifrice from the actuator, preferably onto a user's toothbrush.

In some embodiments, the device may include a reservoir, a pump collar, an actuator, and a pump. The pump may have a reservoir cavity that is configured to hold a volume of dentifrice, the reservoir having a proximal end and a distal end. The pump collar may have a first metering channel and a second metering channel. The first metering channel may have a first channel length, the second metering channel may have a second channel length, and the second channel length may be less than the first channel length. The actuator may have a dispensing aperture, a metering stem, and a stem stop that is coupled to the metering stem. The actuator may be movably coupled to the reservoir, and the actuator may be positionable in a first position and a second position. When the actuator is positioned in the first position and moved towards the distal end, the stem stop is configured to enter the first metering channel and travel the first channel length, and when the actuator is positioned in the second position and moved towards the distal end, the stem stop is configured to enter the second metering channel and travel the second channel length. The pump may be fluid communication with the reservoir and with the dispensing aperture, and the pump may be operated by moving the actuator towards the distal end. The pump may be operable to withdraw a first amount of dentifrice from the reservoir and to dispense the first amount of dentifrice from the dispensing aperture as the stem stop travels the first channel length. The pump may be operable to withdraw a second amount of dentifrice from the reservoir and to dispense the second amount of dentifrice from the dispensing aperture as the stem stop travels the second channel length, and the first amount of dentifrice dispensed may be greater than the second amount of dentifrice.

In further embodiments, the device may include a reservoir, a pump collar, an actuator, and a pump. The pump may have a reservoir cavity that is configured to hold a volume of dentifrice, the reservoir having a proximal end and a distal end. The pump collar may have a first metering channel and a second metering channel. The first metering channel and the second metering channel may be disposed within the collar aperture The first metering channel may have a first channel length, the second metering channel may have a second channel length, and the second channel length may be less than the first channel length. The actuator may have a dispensing aperture, a metering stem, and a stem stop that is coupled to the metering stem. The metering stem may extend into the collar aperture and the stem stop may be positioned within the collar aperture. The actuator may be movably coupled to the reservoir, and the actuator may be positionable in a first position and a second position. When the actuator is positioned in the first position and moved towards the distal end, the stem stop is configured to enter the first metering channel and travel the first channel length, and when the actuator is positioned in the second position and moved towards the distal end, the stem stop is configured to enter the second metering channel and travel the second channel length. The pump may be fluid communication with the reservoir and with the dispensing aperture, and the pump may be operated by moving the actuator towards the distal end. The pump may be operable to withdraw a first amount of dentifrice from the reservoir and to dispense the first amount of dentifrice from the dispensing aperture as the stem stop travels the first channel length. The pump may be operable to withdraw a second amount of dentifrice from the reservoir and to dispense the second amount of dentifrice from the dispensing aperture as the stem stop travels the second channel length, and the first amount of dentifrice dispensed may be greater than the second amount of dentifrice.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
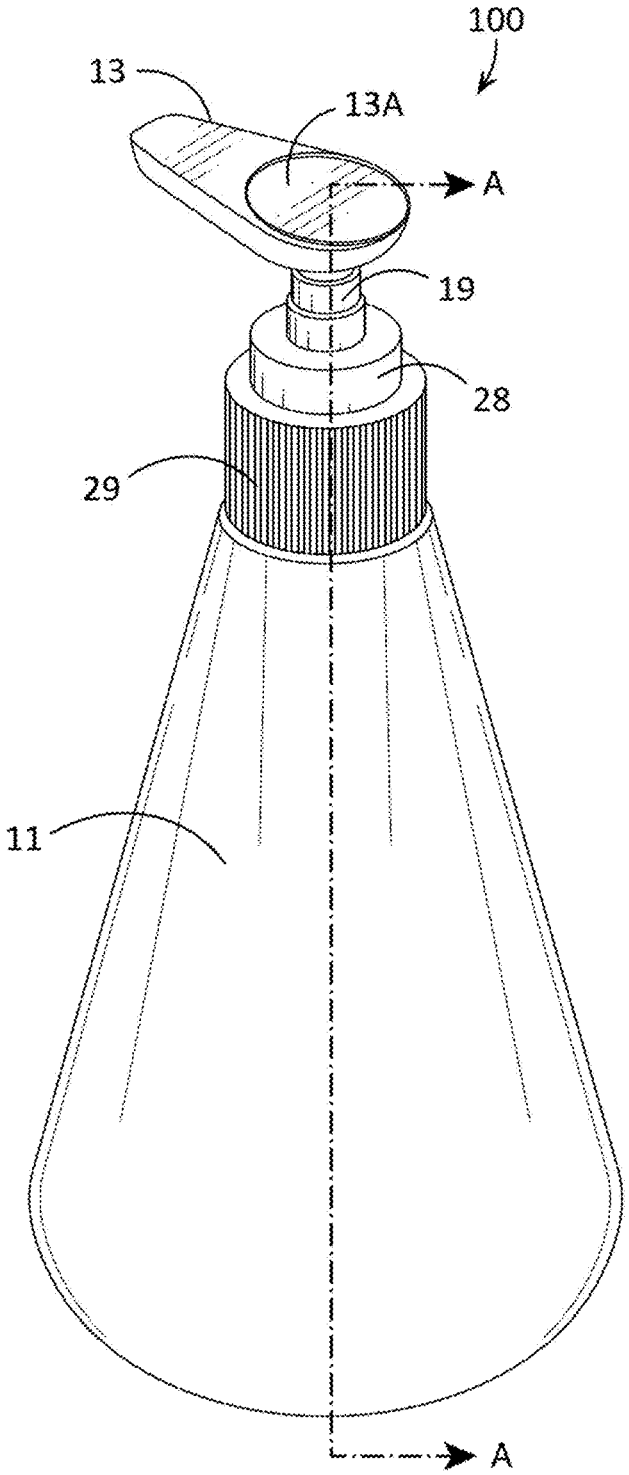
FIG. 1—FIG. 1 depicts a perspective view of an example of a controlled dentifrice dispensing device according to various embodiments described herein.
Figure 2:
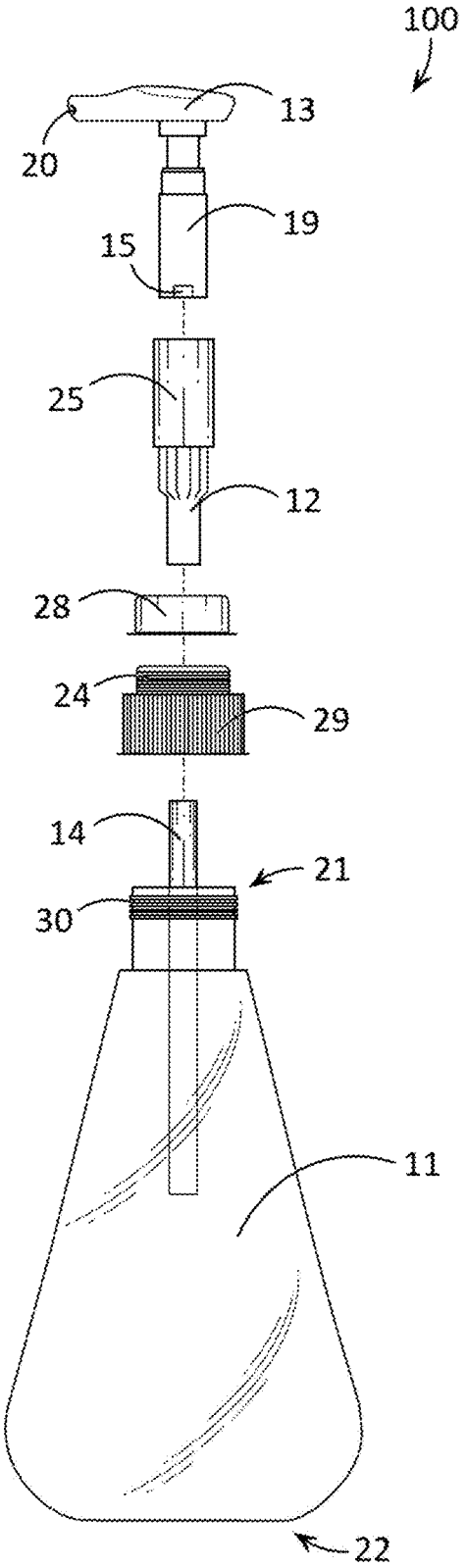
FIG. 2—FIG. 2 illustrates a side elevation exploded view of an example of a controlled dentifrice dispensing device according to various embodiments described herein.
Figure 3:
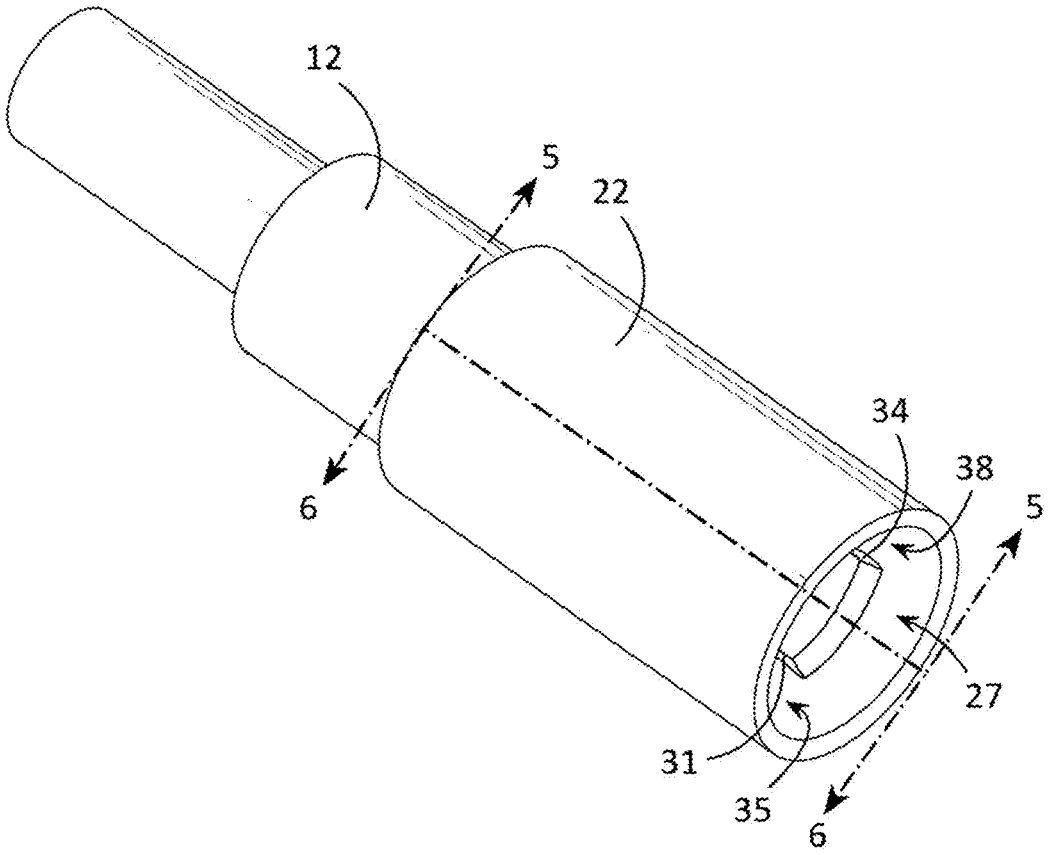
FIG. 3—FIG. 3 shows a perspective view of an example of a pump and pump collar according to various embodiments described herein.
Figure 4:
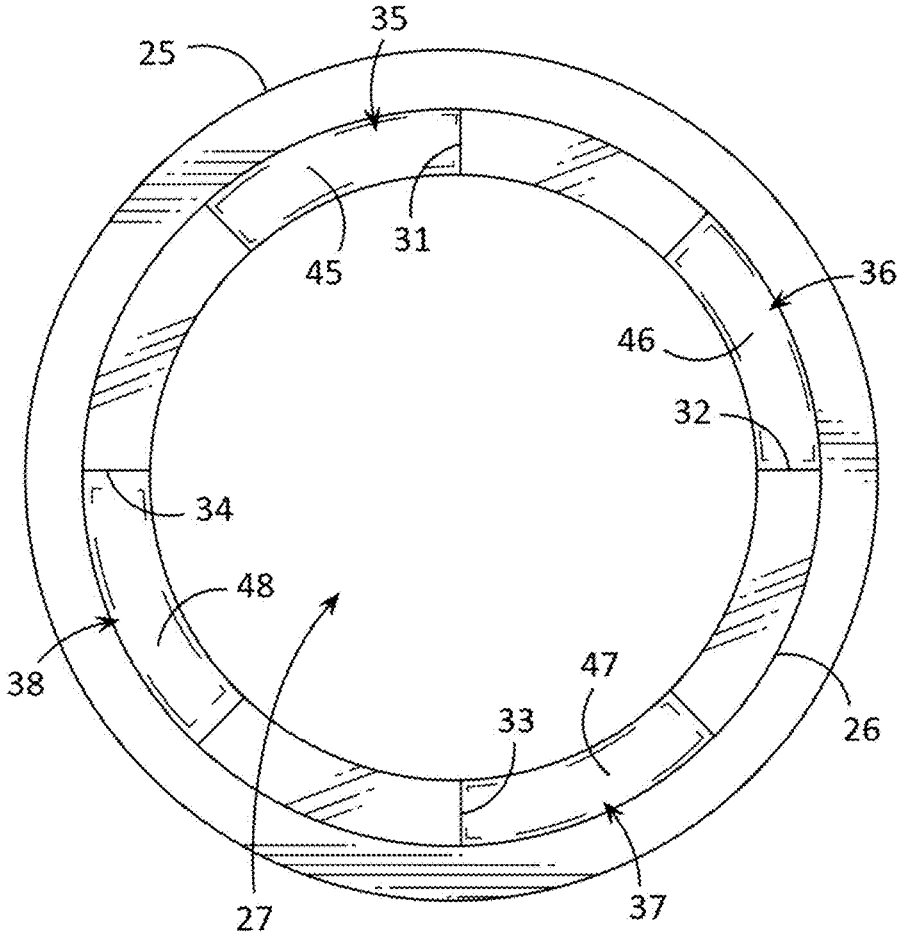
FIG. 4—FIG. 4 depicts a top plan view of an example of a pump collar according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new controlled dentifrice dispensing device is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-2, and 7-10 illustrate examples of a controlled dentifrice dispensing device ("the device") 100 according to various embodiments. In some embodiments, the device 100 may include a reservoir 11 that is configured to hold a volume of dentifrice 200. A pump 12 may be coupled to the reservoir 11 and configured to withdraw dentifrice 200 from the reservoir 11 when the pump 12 is operated by an actuator 13. The pump 12 may be operated by the actuator 13 when the actuator 13 is moved, such as by being pressed, towards the reservoir 11. The distance that the actuator 13 is able to be pressed towards the reservoir 11 may be controlled by a plurality of metering channels 31, 32, 33, 34, that may extend longitudinally towards the distal end 22 of the reservoir 11 and that may interact, directly or indirectly, with the actuator 13. When the actuator 13 interacts with a relatively longer metering channel 31, 32, 33, 34, the actuator 13 may operate the pump 12 to a greater degree than when the actuator 13 interacts with a relatively shorter metering channel 31, 32, 33, 34, thereby allowing the pump 12 to withdraw a greater amount of dentifrice 200 from the reservoir 11 and to dispense the greater amount of dentifrice 200 from the actuator 13, preferably onto a user's toothbrush 201.

The device 100 may comprise a reservoir 11 having a cavity 16 that is configured to hold a desired volume of dentifrice 200. Preferably, a cavity 16 of a reservoir 11 may be configured to hold a volume of dentifrice 200 that may be between 3 ounces and 10 ounces, although it may be configured to hold larger or smaller amounts.

The reservoir 11 may have a proximal end 21 and an opposing distal end 22, and the proximal end 21 may be movably coupled to the actuator 13 so that the actuator 13 may be moved relative to the reservoir 11. Preferably, a reservoir 11 may comprise one or more reservoir walls 23 that may extend between the proximal end 21 and distal end 22. A reservoir 11 may be configured in any shape and size. For example, a reservoir 11 may comprise a generally bulbous shaped reservoir wall 23 and the reservoir 11 may be generally bulbous shaped as shown in FIGS. 1-2, and 7-10. As another example, a reservoir 11 may comprise four generally rectangular shaped reservoir walls 23 that may be coupled together so that the reservoir 11 may be generally shaped as a rectangular prism. As a further example, a reservoir 11 may comprise a generally cylindrical shaped reservoir wall 23 and the reservoir 11 may be generally cylindrically shaped.

In some embodiments, the device 100 may comprise a pump ring 28 and/or a reservoir collar 29 which may be configured to couple, and more preferably to removably couple, the pump 12 and/or one or more other elements to the proximal end 21 the reservoir 11. For example, the pump ring 28 may removably couple the pump 12 to the reservoir collar 29 via a threaded engagement (e.g., using threading 24) between the pump ring 28 and reservoir collar 29, and the reservoir collar 29 may be coupled to the reservoir 11 via a threaded engagement (e.g., using threading 30) so that the pump 12 is removably coupled to proximal end 21 via threading 24, 30. In further embodiments, any suitable coupling device or method may be used to couple the pump 12 to the reservoir 11, and preferably removably coupled so that the reservoir 11 cavity 16 may be filled and refilled.

The device 100 may comprise an actuator 13 which may be movably coupled, either directly or indirectly, to the reservoir 11. For example, an actuator 13 may be coupled to the movable piston 12A of the pump 12, and the pump 12 may be coupled to the reservoir 11 so that the actuator 13 may be indirectly movably coupled to the reservoir 11. In preferred embodiments, the actuator 13 may be rotatably coupled, either directly or indirectly such as by being coupled to the pump 12, to the reservoir 11 so that the actuator 13 may be configured to be rotated into and between one or more positions 71, 72, (FIGS. 7-9) in which each position 71, 72, corresponds to the stem stop 15 being aligned with and being able to enter a specific metering channel 31, 32, 33, 34.

In preferred embodiments, the actuator 13 may be biased away from the distal end 22 of the reservoir 11 so that after a user stops pressing or motivating the actuator 13 to be relatively closer to the distal end 22, the actuator 13 may return to a position that is relatively farther from the distal end 22. An actuator 13 may be biased away from the distal end 22 via a spring 18, or other suitable biasing device or method. Example, springs include tension/extension springs, compression springs, constant-force springs, torsion springs, variable springs, coil springs, etc.

The actuator 13 may comprise a conduit 17 that may extend through the actuator 13. The conduit 17 may provide fluid communication between the pump 12 and dispensing aperture 20. An actuator 13 may be configured in any size and shape. Preferably, an actuator 13 may comprise a top wall 13A that may form the portion of the actuator 13 that is most distal to the reservoir 11, and a user may contact and press on the top wall 13A to move the actuator 13 towards the distal end 22.

In preferred embodiments, a user may press or otherwise move or motivate the actuator 13 in order to engage or operate the pump 12. In preferred embodiments, an actuator 13 may be moved or pressed towards the distal end 22 of the reservoir 11. An actuator 13 may dispense dentifrice 200 motivated out of the reservoir cavity 16 by the pump 12 through a dispensing aperture 20. Generally, a dispensing aperture 20 may form an opening that may be in communication with the conduit 17 that enables dentifrice 200 that is motivated by the pump 12 to exit the device 100.

An actuator 13 may comprise a metering stem 19 that may be configured to couple the actuator 13 to the pump 12, pump collar 25, or other element of the device 100 so that fluid communication is established between the dispensing aperture 20 of the actuator 13 and the pump 12 by the metering stem 19. The metering stem 19 may comprise a stem stop 15 that may be configured to interact with the metering channels 31, 32, 33, 34, of the pump collar 25. In some embodiments, a stem stop 15 may be positioned within a collar aperture 27 of the pump collar 25. In preferred embodiments, a lower portion of the metering stem 19 and the stem stop 15 may be slidably received in a collar aperture 27 of the pump collar 25 so that the metering stem 19 remains in the collar aperture 27 when the actuator 13 is moved towards and away from the distal end 22 and when the actuator is rotated between positions 71, 72.

A stem stop 15 may comprise a protrusion that may enter and interact with the metering channels 31, 32, 33, 34, and which may operably couple the pump piston 12A to the actuator 13 in order to control the stroke of the pump 12 and therefore to control the amount of dentifrice 200 that may be motivated by the pump 12 to exit the device 100. In some embodiments, a lower portion of the metering stem 19 and the stem stop 15 may extend into the collar aperture 27 of the pump collar 25 and may be slidably and rotatably received in the collar aperture 27. In further embodiments, the metering channels 31, 32, 33, 34 may be formed on the exterior of the pump collar 25, and the metering stem 19 may fit over the pump collar 25, such as within a central aperture formed in and extending through the metering stem 19 and in which the stem stop 15 is disposed within the central aperture of the metering stem 19.

A stem stop 15 may be configured in any size and shape which may enable the stem stop 15 to contact portions of a metering channel 31, 32, 33, 34, including a stop wall 45, 46, 47, 48, of the metering channels 31, 32, 33, 34. As an example, a stem stop 15 may comprise a rectangular prism shaped protrusion that may extend away from the metering stem 19. As another example, a stem stop 15 may comprise a cylindrical protrusion or any other shaped protrusion that may extend away from the metering stem 19.

The device 100 may comprise a pump 12 that may be configured to withdraw dentifrice 200 from the reservoir 11 when the pump 12 is operated by an actuator 13. A pump 12 may comprise any pumping device that is capable of pumping liquid, gel, and paste dentifrices. As an example, a pump 12 may rely on components, such as the actuator 13, a piston 12A, a pump spring 18, and one or more balls 12C, 12D, to produce suction to withdraw the fluid from the reservoir 11 and to dispense it out of the actuator 13. Each time a user pushes down on, or primes, the actuator 13, the actuator 13 pressed on and operates the piston 12A so that the piston 12A puts pressure on the spring 18 and moves an upper ball 12C upward, taking some fluid with it. When the user releases the actuator 13, the piston 12A, upper ball 12C, and spring 18 return to their resting position, and the upper ball 12C seals off the chamber of the piston 12A to stop fluid from flowing into the reservoir 11 while the lower ball 12D unseals to enable fluid communication between the pump 12 and reservoir cavity 16. In further embodiments, any other suitable manually operated pumping mechanism may be used.

Preferably, the device 100 may comprise a dip tube 14 that may be coupled to the pump 12 and which may extend into the reservoir 11. The dip tube 14 may comprise a fluid conduit, such as a hollow tube, through which the pump 12 may withdraw fluid from the reservoir 11 preferably near the bottom of the reservoir 11.

The device 100 may comprise one or more metering channels 31, 32, 33, 34, such as a first metering channel 31, a second metering channel 32, a third metering channel 33, a fourth metering channel 34, etc., which may be formed in one or more pump collar walls 26 of the pump collar 25. In some embodiments, pump collar 25 may comprise a collar aperture 27 and a generally cylindrical shaped pump collar wall 26, and the collar aperture 27 may extend through the pump collar 25, and the metering channels 31, 32, 33, 34 may be formed on the interior of the pump wall 26 so as to be disposed within the collar aperture 27.

A pump collar 25 may be coupled to the pump 12 or to another element of the device 100 so that the pump collar 25 is positioned above the pump 12. Preferably, the pump collar 25 may physically guide the movement of the metering stem 19, and therefore the movement of the actuator 13. In preferred embodiments, the metering stem 19 may be movably coupled to the pump collar 25 so that the metering stem 19 extends into the collar aperture 27 and so that the stem stop 15 is positioned within the collar aperture 27 to allow the stem stop 15 to be moved towards and away from the pump 12 and to allow the stem stop 15 to be rotated into and between one or more positions 71, 72, in which each position 71, 72, corresponds with the stem stop 15 being aligned with a metering channel 31, 32, 33, 34. Once the step stop 15 is aligned with a metering channel 31, 32, 33, 34, the actuator 13 may be pressed down towards the pump 12 and distal end 22 to cause the step stop 15 to enter a metering channel 31, 32, 33, 34.

Generally, a metering channel 31, 32, 33, 34, may comprise a channel, recess, or track that a stem stop 15 may fit into, and the distance that the actuator 13 may be moved towards the pump 12 and distal end 22 may be governed by the length of the metering channel 31, 32, 33, 34, that the stem stop 15 is moved into. Preferably, each metering channel 31, 32, 33, 34, may be positioned proximate to the upper end of the pump collar 25 (end of pump collar 25 that is proximate to the actuator 13.

Figure 6:
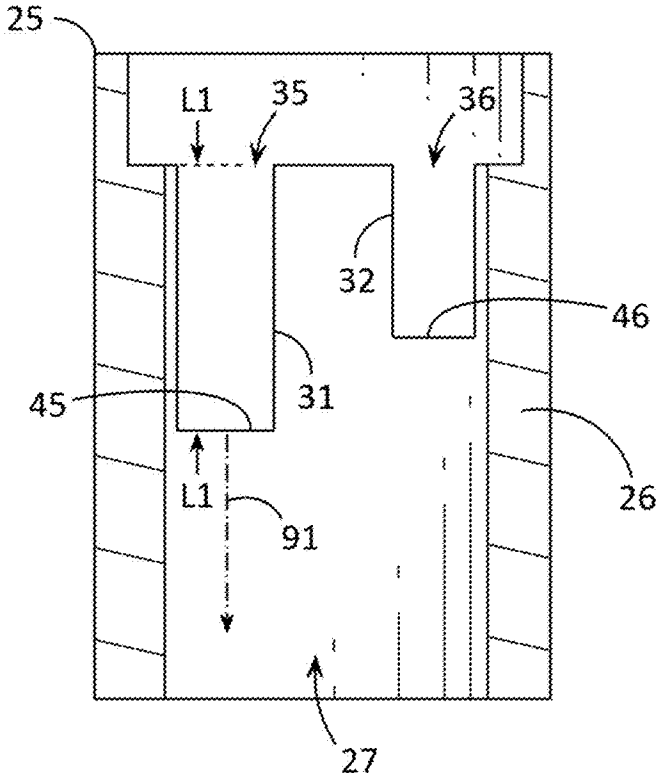
FIG. 6—FIG. 6 shows a sectional, through line 6-6 shown in FIG. 3, elevation view of an example of a pump collar according to various embodiments described herein.
Figure 5:
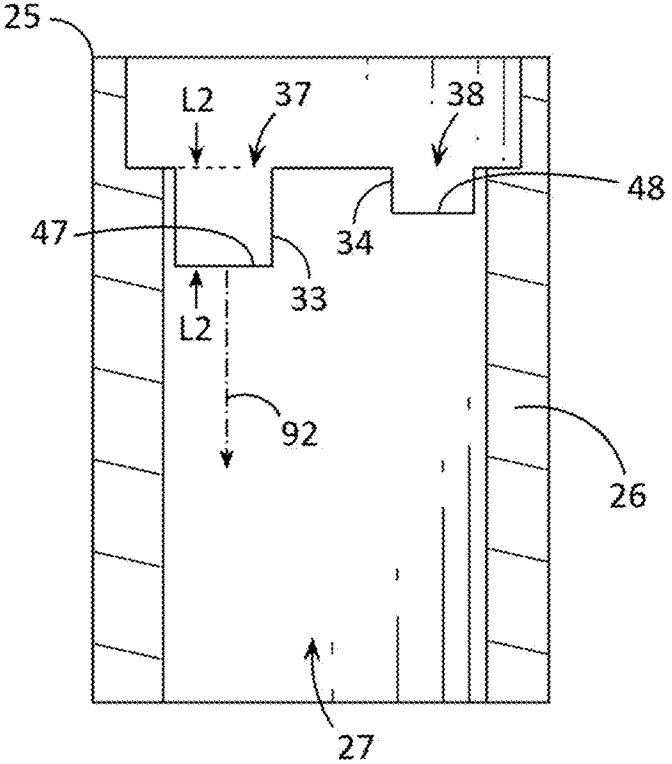
FIG. 5—FIG. 5 illustrates a sectional, through line 5-5 shown in FIG. 3, elevation view of an example of a pump collar according to various embodiments described herein.
Figure 7:
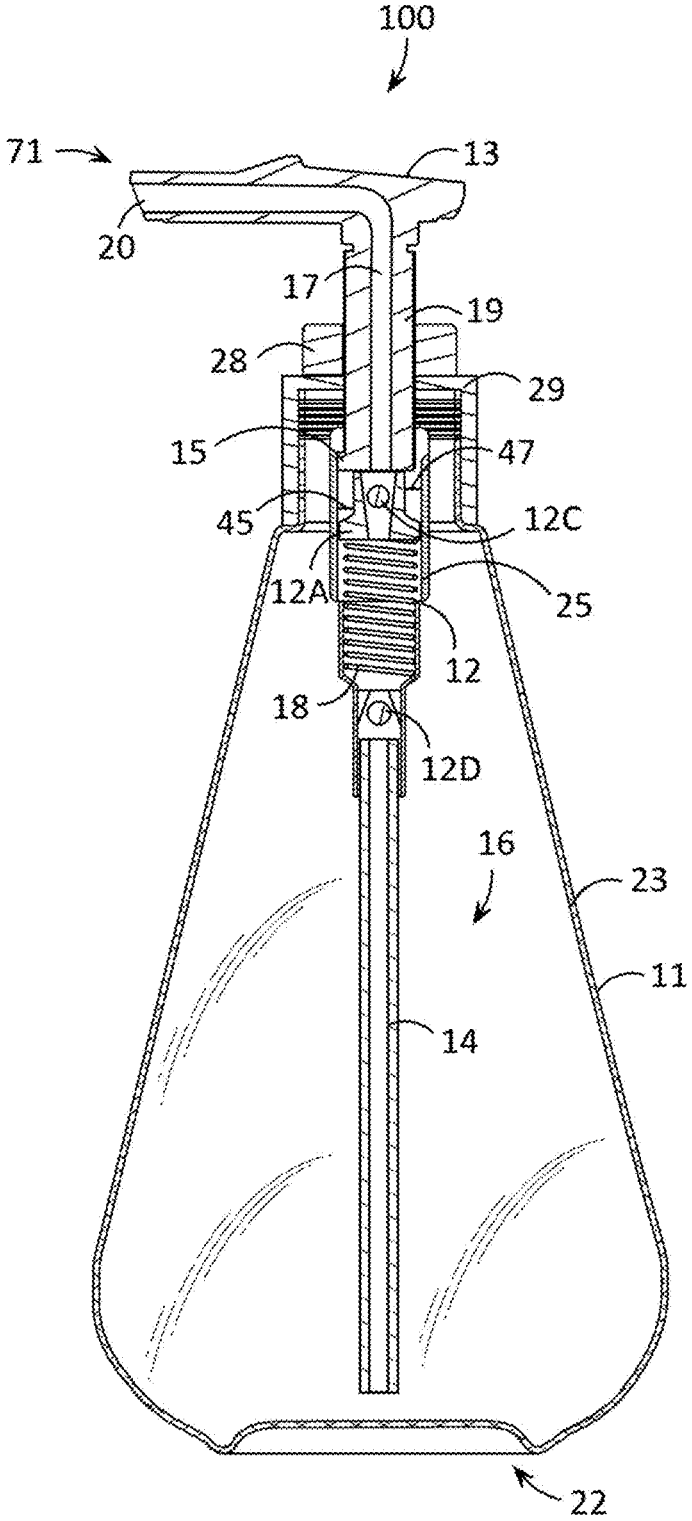
FIG. 7—FIG. 7 depicts a sectional, through line A-A shown in FIG. 1, elevation view of an example of a controlled dentifrice dispensing having the actuator in a first position according to various embodiments described herein.
Figure 8:
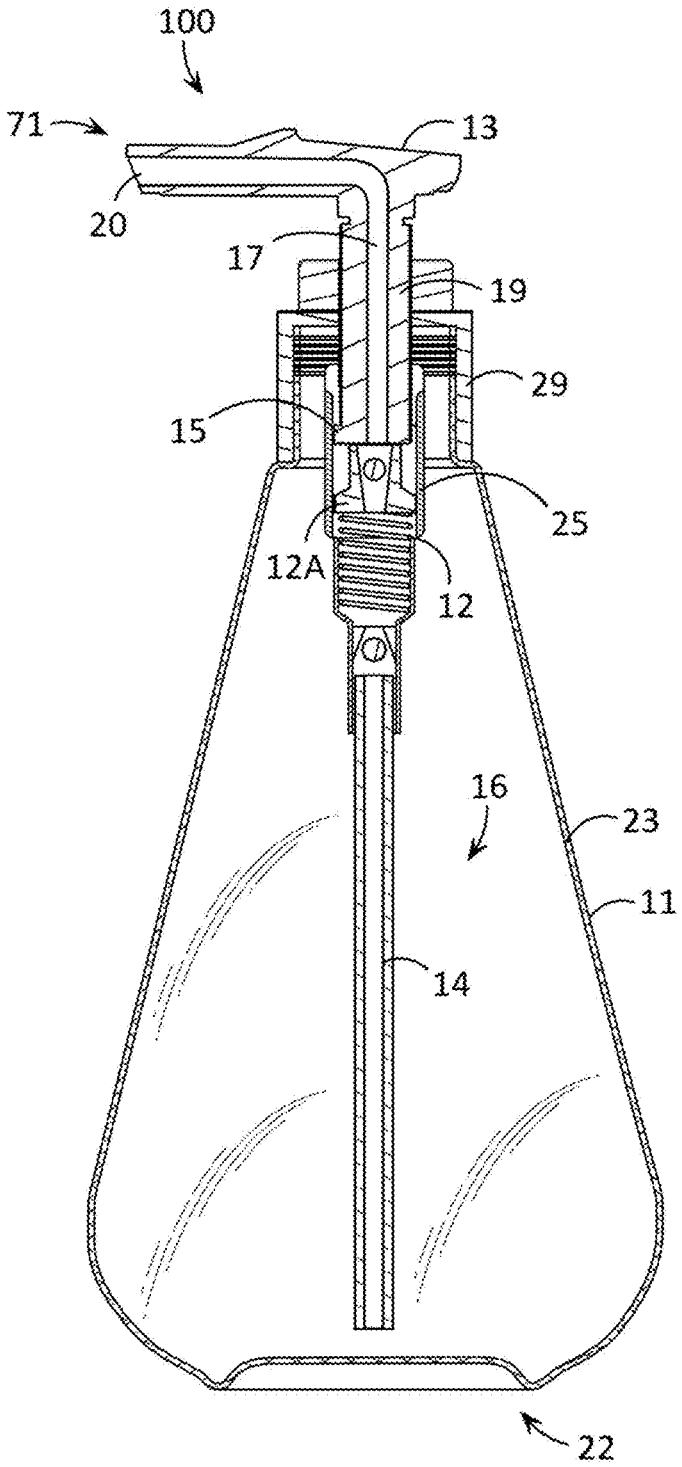
FIG. 8—FIG. 8 illustrates the controlled dentifrice dispensing of FIG. 7 having the actuator pressed towards the distal end of a reservoir.
Figure 9:
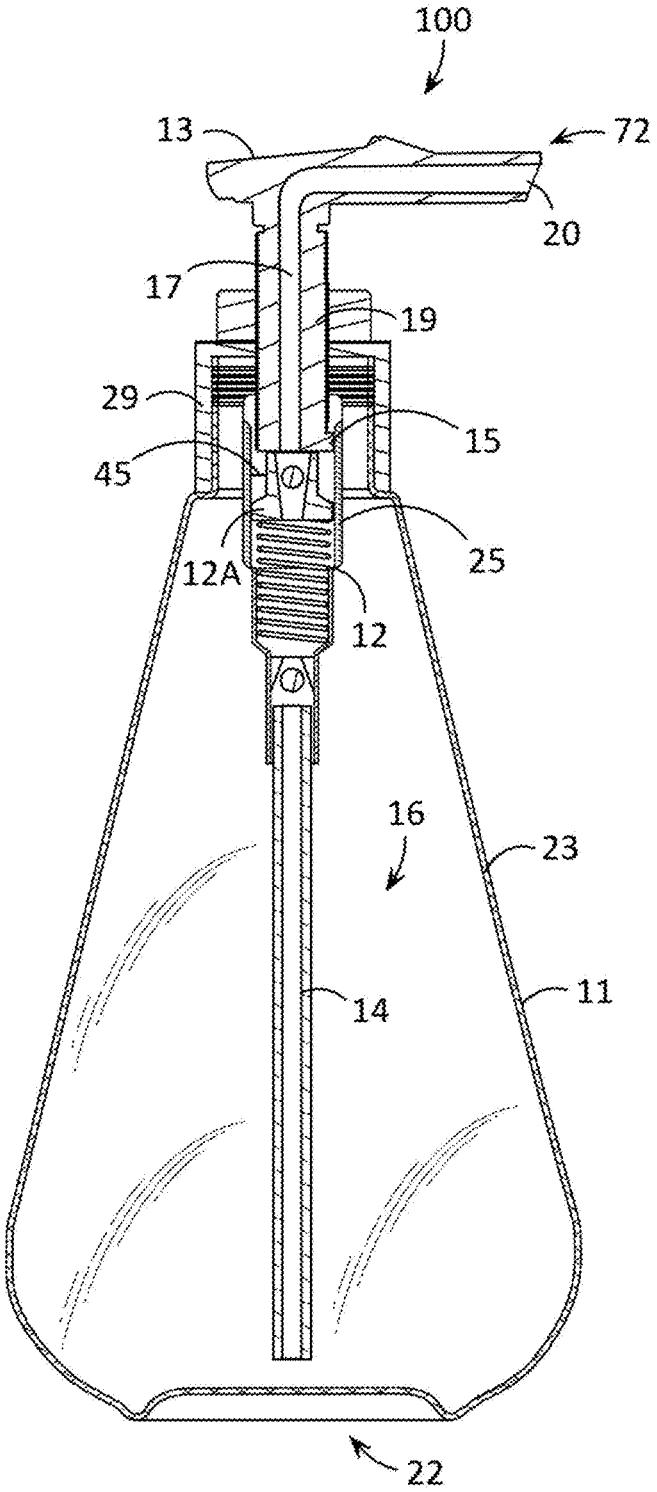
FIG. 9—FIG. 9 shows the controlled dentifrice dispensing of FIGS. 7 and 8 having the actuator in a second position according to various embodiments described herein.
Figure 10:
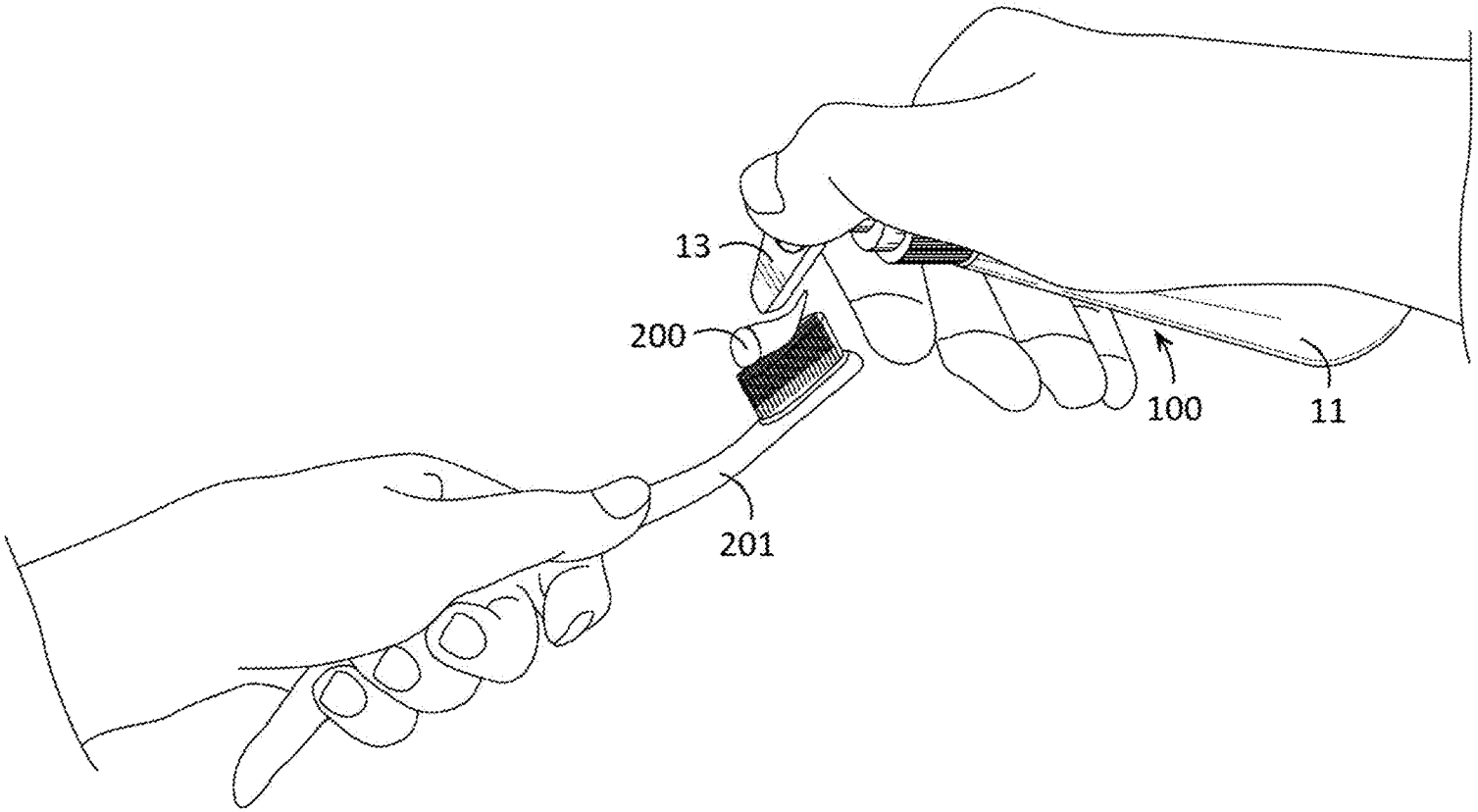
FIG. 10—FIG. 10 depicts a perspective view of an example of a user using a controlled dentifrice dispensing device to dispense dentifrice onto a toothbrush according to various embodiments described herein.

Metering channels 31, 32, 33, 34, may be configured in any size and shape. In preferred embodiments, one or more metering channels 31, 32, 33, 34, may be elongated in shape, and one or more metering channels 31, 32, 33, 34, that are elongated in shape may each be elongated in a substantially parallel direction (plus or minus 10 degrees) to each other. For example, and as shown in FIGS. 5 and 6, the device 100 may comprise a first metering channel 31 that may be elongated in a first direction 91 and a third metering channel 33 that may be elongated in a second direction 92, and the first direction 91 may be substantially parallel (plus or minus 10 degrees) to the second direction 92.

In some embodiments, the device 100 may comprise a pump collar 25 having one or more metering channels 31, 32, 33, 34, and an actuator 13 may be movably coupled to the pump collar 25. The actuator 13 may be rotated to a position, such as a first position 71, a second position 72, etc., so that when the actuator 13 is pressed down to operate the pump 12, the stem stop 15 of the actuator 13 may enter a desired metering channel 31, 32, 33, 34, and the downward movement of the actuator 13, and therefore pump stroke of the pump 12, may be limited or stopped when the stem stop 15 contacts the bottom or stop wall 45, 46, 47, 48, of the desired metering channel 31, 32, 33, 34. When the stem stop 15 is pressed down into a relatively longer metering channel 31, 32, 33, 34, the actuator 13 may engage the pump 12 to a greater degree than when the stem stop 15 is pressed down into a relatively shorter metering channel 31, 32, 33, 34, thereby allowing the pump 12 to withdraw a greater amount of dentifrice 200 from the reservoir 11 and to dispense the greater amount of dentifrice 200 from the dispensing aperture 20. In some embodiments, one or more metering channels 31, 32, 33, 34, may be coupled to the pump collar 25 by being formed, e.g., cut into, recessed, molded into, etc., into a pump collar wall(s) 26. In further embodiments, one or more metering channels 31, 32, 33, 34, may be coupled to the pump collar 25 using any suitable coupling method or manufacturing technique.

Each metering channel 31, 32, 33, 34, may comprise a channel entrance 35, 36, 37, 38, and a stop wall 45, 46, 47, 48. Preferably, channel entrances 35, 36, 37, 38, may each be the same distance from the distal end 22 of the reservoir 11 (once the pump collar 25 is coupled to the reservoir 11), while each stop wall 45, 46, 47, 48, may be a different distance from the distal end 22 of the reservoir 11 relative to the other stop walls 45, 46, 47, 48. Preferably, the distance between the channel entrance 35, 36, 37, 38, and stop wall 45, 46, 47, 48, of a metering channel 31, 32, 33, 34, may define the channel length of that metering channel 31, 32, 33, 34. For example, and as perhaps best shown in FIGS. 5 and 6, the device 100 may comprise a first metering channel 31 that may have a first channel length (L1) and a third metering channel 33 that may have a second channel length (L2), and the second channel length (L2) may be less than the first channel length (L1). Still referring to this example, the first metering channel 31 may have a stop wall 45 and the third metering channel 33 may have a stop wall 47, and the stop wall 45 of the first metering channel 31 may be closer to the distal end 22 and pump 12 relative to the stop wall 47 of the third metering channel 33 when the pump collar 25 is coupled to the pump 12 and reservoir 11. The actuator 13 may be movably coupled to the reservoir 11, so that the actuator is positionable in one or more positions 71, 72, (FIGS. 7-9), such as a first position 71 and a second position 72, with each position 71, 72, corresponding with the stem stop 15 of the actuator 13 being aligned with a metering channel 31, 32, 33, 34. Still referring to the example of FIGS. 5 and 6, when the actuator 13 is positioned in the first position 71 and moved towards the distal end 22, the stem stop 15 is configured to enter the first metering channel 31 and travel the first channel length (L1), and when the actuator 13 is positioned in the second position 72 and moved towards the distal end 22, the stem stop 15 is configured to enter the third metering channel 33 and travel the second channel length (L2). The pump 12 may be operated by moving the actuator 13 towards the distal end 22 so that the metering stem 19 may actuate the piston 12A of the pump 12. The pump 12 may be operable to withdraw a first amount of dentifrice 200 from the reservoir 11 and to dispense the first amount of dentifrice 200 from the dispensing aperture 20 as the stem stop 15 travels the first channel length (L1), and the pump 12 may be operable to withdraw a second amount of dentifrice 200 from the reservoir 11 and to dispense the second amount of dentifrice 200 from the dispensing aperture 20 as the stem stop 15 travels the second channel length (L2). Since the first channel length (L1) in this example is greater than the second channel length (L2), the first amount of dentifrice 200 dispensed from the dispensing aperture 20 is greater than the second amount of dentifrice 200 dispensed from the dispensing aperture 20.

The device 100 may comprise any number of metering channels 31, 32, 33, 34, preferably with each metering channel 31, 32, 33, 34, having a different depth (so that the stop wall 45, 46, 47, 48, of each metering channel 31, 32, 33, 34, may be a different distance from the distal end 22) and so that when the stem stop 15 is pressed down into a metering channel 31, 32, 33, 34, the pump 12 may dispense a different amount of dentifrice from the dispensing aperture 20 depending on which metering channel 31, 32, 33, 34, the stem stop 15 is pressed into. For example, the reservoir 11 may comprise four metering channels 31, 32, 33, 34, with the shortest metering channel 34 allowing approximately 5 grams (or corresponding volume) of dentifrice 200 to be dispensed, the next longest metering channel 33 allowing approximately 25 grams (or corresponding volume) of dentifrice 200 to be dispensed, the next longest metering channel 32 allowing approximately 50 grams (or corresponding volume) of dentifrice 200 to be dispensed, and the longest metering channel 31 allowing approximately 75 grams (or corresponding volume) of dentifrice 200 to be dispensed.

While some exemplary shapes and sizes have been provided for elements of the device 100, it should be understood to one of ordinary skill in the art that the reservoir 11, pump collar 12, actuator 13, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the device 100 may be made from or may comprise durable materials such as aluminum, steel, other metals and metal alloys, wood, hard rubbers, hard plastics, fiber reinforced plastics, carbon fiber, fiberglass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the device 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the device 100 may be coupled or removably connected by being press fit or snap fit together, by one or more fasteners such as magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the device 100 may be coupled by being one of connected to and integrally formed with another element of the device 100.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A controlled dentifrice dispensing device, the device comprising:

a reservoir having a reservoir cavity that is configured to hold a volume of dentifrice, the reservoir having a proximal end and a distal end;

a pump collar having a first metering channel and a second metering channel, wherein the first metering channel comprises a first channel length, wherein the second metering channel comprises a second channel length, and wherein the second channel length is less than the first channel length;

an actuator having a dispensing aperture, a metering stem, and a stem stop that is coupled to the metering stem, the actuator movably coupled to the reservoir, wherein the stem stop is positioned within a collar aperture of the pump collar, wherein the actuator is positionable in a first position and a second position, wherein when the actuator is positioned in the first position and moved towards the distal end, the stem stop is configured to enter the first metering channel and travel the first channel length, and wherein when the actuator is positioned in the second position and moved towards the distal end, the stem stop is configured to enter the second metering channel and travel the second channel length; and a pump in fluid communication with the reservoir and with the dispensing aperture, wherein the pump is operated by moving the actuator towards the distal end, wherein the pump is operable to withdraw a first amount of dentifrice from the reservoir and to dispense the first amount of dentifrice from the dispensing aperture as the stem stop travels the first channel length, wherein the pump is operable to withdraw a second amount of dentifrice from the reservoir and to dispense the second amount of dentifrice from the dispensing aperture as the stem stop travels the second channel length, and wherein the first amount of dentifrice is greater than the second amount of dentifrice.

2. The device of claim 1, wherein the pump collar is coupled to the pump.

3. The device of claim 1, wherein the pump is removably coupled to the proximal end of the reservoir.

4. The device of claim 3, wherein the pump is removably coupled to the proximal end via threading.

5. The device of claim 1, wherein the first metering channel comprises a first stop wall and the second metering channel comprises a second stop wall, and wherein the first stop wall is closer to the distal end relative to the second stop wall.

6. The device of claim 1, wherein the first metering channel is elongated in a first direction and the second metering channel is elongated in a second direction, and wherein the first direction is substantially parallel to the second direction.

7. The device of claim 1, wherein actuator is rotatably coupled to the reservoir so that the actuator is configured to be rotated into and between the first position and the second position.

8. The device of claim 1, wherein the pump comprises a piston, a spring, and a ball.

9. The device of claim 1, further comprising a dip tube coupled to the pump, wherein the dip tube extends into the reservoir.

10. The device of claim 1, wherein the first metering channel and the second metering channel are disposed within the collar aperture.

11. A controlled dentifrice dispensing device, the device comprising:

a reservoir having a reservoir cavity that is configured to hold a volume of dentifrice, the reservoir having a proximal end and a distal end;

a pump collar having a collar aperture, a first metering channel, and a second metering channel, wherein the first metering channel and the second metering channel are disposed within the collar aperture, wherein the first metering channel comprises a first channel length, wherein the second metering channel comprises a second channel length, and wherein the second channel length is less than the first channel length;

an actuator having a dispensing aperture, a metering stem, and a stem stop that is coupled to the metering stem, the actuator movably coupled to the reservoir, wherein the metering stem extends into the collar aperture and the stem stop is positioned within the collar aperture, wherein the actuator is positionable in a first position and a second position, wherein when the actuator is positioned in the first position and moved towards the distal end, the stem stop is configured to enter the first metering channel and travel the first channel length, and wherein when the actuator is positioned in the second position and moved towards the distal end, the stem stop is configured to enter the second metering channel and travel the second channel length; and a pump in fluid communication with the reservoir and with the dispensing aperture, wherein the pump is operated by moving the actuator towards the distal end, wherein the pump is operable to withdraw a first amount of dentifrice from the reservoir and to dispense the first amount of dentifrice from the dispensing aperture as the stem stop travels the first channel length, wherein the pump is operable to withdraw a second amount of dentifrice from the reservoir and to dispense the second amount of dentifrice from the dispensing aperture as the stem stop travels the second channel length, and wherein the first amount of dentifrice is greater than the second amount of dentifrice.

12. The device of claim 11, wherein the pump collar is coupled to the pump.

13. The device of claim 11, wherein the pump is removably coupled to the proximal end of the reservoir.

14. The device of claim 13, wherein the pump is removably coupled to the proximal end via threading.

15. The device of claim 11, wherein the first metering channel comprises a first stop wall and the second metering channel comprises a second stop wall, and wherein the first stop wall is closer to the distal end relative to the second stop wall.

16. The device of claim 11, wherein the first metering channel is elongated in a first direction and the second metering channel is elongated in a second direction, and wherein the first direction is substantially parallel to the second direction.

17. The device of claim 11, wherein actuator is rotatably coupled to the reservoir so that the actuator is configured to be rotated into and between the first position and the second position.

18. The device of claim 11, wherein the pump comprises a piston, a spring, and a ball.

19. The device of claim 11, further comprising a dip tube coupled to the pump, wherein the dip tube extends into the reservoir.

* * * * *